US010655593B2

(12) United States Patent
Lajda et al.

(10) Patent No.: US 10,655,593 B2
(45) Date of Patent: May 19, 2020

(54) IGNITION DEVICE

(71) Applicant: PRUEFREX Engineering e Motion GmbH & Co. Kg, Cadolzburg (DE)

(72) Inventors: Marek Lajda, Fuerth (DE); Jochen Heubeck, Langenzenn (DE)

(73) Assignee: PRUEFREX Engineering e Motion GmbH & Co. KG, Cadolzburg (DE)

( * ) Notice: Subject to any disclaimer, the term of this patent is extended or adjusted under 35 U.S.C. 154(b) by 0 days.

(21) Appl. No.: 16/203,761

(22) Filed: Nov. 29, 2018

(65) Prior Publication Data

US 2019/0162157 A1 May 30, 2019

(30) Foreign Application Priority Data

Nov. 29, 2017 (DE) ..... 10 2017 221 448

(51) Int. Cl.

| | |
|---|---|
| ***F02P 5/15*** | (2006.01) |
| ***F02P 13/00*** | (2006.01) |
| ***F02P 5/04*** | (2006.01) |
| ***F02P 3/04*** | (2006.01) |
| ***F02P 7/07*** | (2006.01) |
| *F02P 7/03* | (2006.01) |

(52) U.S. Cl.

CPC ..... *F02P 5/151* (2013.01); *F02P 3/0407* (2013.01); *F02P 5/045* (2013.01); *F02P 7/07* (2013.01); *F02P 13/00* (2013.01); *F02P 7/03* (2013.01)

(58) Field of Classification Search

CPC ..... F02P 5/151; F02P 5/045; F02P 3/0407; F02P 7/07; F02P 7/03; F02P 13/00

USPC ..... 123/406.18, 406.58, 612, 605, 618, 634, 123/635, 647

See application file for complete search history.

(56) References Cited

U.S. PATENT DOCUMENTS

| | | | | | |
|---|---|---|---|---|---|
| 4,870,587 | A * | 9/1989 | Kumagai | F02B 77/087 | 701/110 |
| 4,951,630 | A * | 8/1990 | Iwata | F02P 5/1455 | 123/406.42 |
| 4,962,738 | A * | 10/1990 | Iwata | F02P 5/106 | 123/406.43 |
| 5,136,996 | A * | 8/1992 | Kushi | F02D 37/02 | 123/332 |
| 5,713,338 | A * | 2/1998 | Wheeler | F02P 15/008 | 123/637 |
| 6,012,427 | A * | 1/2000 | Hoy | F02P 7/0675 | 123/406.5 |

(Continued)

*Primary Examiner* — Hai H Huynh
(74) *Attorney, Agent, or Firm* — Muncy, Geissler, Olds & Lowe, P.C.

(57) ABSTRACT

An ignition device for an internal combustion engine, having a housing in which a crankshaft sensor is accommodated for detecting the rotational speed and/or the position of a crankshaft, which is in particular provided with a toothed position sensor and in which at least one ignition transformer with a primary winding is accommodated, and a secondary winding for generating a spark for the internal combustion engine is accommodated, wherein a number of input ports, in particular for the connection of an electrical energy source for supplying the or each ignition transformer and/or for supplying sensor and/or control signals, and in which a plurality of output ports, in particular for connecting at least one spark plug and/or for emitting control signals, are provided.

15 Claims, 6 Drawing Sheets

(56) References Cited

U.S. PATENT DOCUMENTS

| | | | | |
|---|---|---|---|---|
| 6,907,342 | B1 * | 6/2005 | Matsuoka | F02D 41/009 123/406.6 |
| 7,299,680 | B2 * | 11/2007 | Okubo | G01L 23/225 123/406.42 |
| 2013/0118001 | A1 * | 5/2013 | Nutter | F02D 45/00 29/593 |

* cited by examiner

IGNITION DEVICE

This nonprovisional application claims priority under 35 U.S.C. § 119(a) to German Patent Application No. 10 2017 221 448.1, which was filed in Germany on Nov. 29, 2017, and which is herein incorporated by reference.

BACKGROUND OF THE INVENTION

Field of the Invention

The present invention relates to an ignition device for an internal combustion engine.

Description of the Background Art

An internal combustion engine designed as a small engine, such as a small engine of a lawn mower or a power generator, in particular has a system for an ignition function and for electronic fuel injection or for mixture control. In particular, a small engine here is understood to be a two-stroke engine with a capacity of up to 350 $cm^3$ and/or a four-stroke engine with one or two cylinders and a capacity of up to 1000 $cm^3$.

Such systems include a number of individual components. For example, included are ignition coils, injection valves, gasoline pumps, speed sensors, temperature sensors, pressure sensors and/or control units. These individual components are for example mounted separately in or on the engine.

In this case, a corresponding number of cables (wiring harness) is necessary to interconnect the individual components. The disadvantage here are costs incurred due to the relatively high cabling or assembly costs and due to the plug contacts (plugs and/or sockets) needed for wiring or interconnecting the individual components. In particular, the individual component or components which are used to generate an ignition spark in an internal combustion chamber of an engine are collectively referred to as ignition devices.

To save costs and/or to reduce the assembly effort required, for example, individual components may be combined into a shared device and/or integrated on/in the combustion engine for purposes of mixture formation. It is also possible to directly mount a control unit of the electronic fuel injection to a throttle body and connect it with the throttle valve or an exhaust connection via an integrated potentiometer or pressure sensor. Further, it is possible to integrate electric motor units into a control unit, for example, in order to electrically actuate a throttle valve (E-throttle) and/or choke valve (E-choke).

SUMMARY OF THE INVENTION

It is therefore an object of the present invention to provide an ignition device in which the assembly effort and/or assembly costs are minimized.

According to an exemplary embodiment of the invention, the ignition device, which is provided for an internal combustion engine, particularly for a small engine designed as a one cylinder four-stroke engine or as a two-cylinder four-stroke engine, comprises a housing in which a crankshaft sensor (CPS sensor, crankshaft position sensor) is accommodated for detecting the rotational speed and/or the position of a crankshaft provided with, in particular, a toothed position sensor. Further, at least one ignition transformer (ignition coil) having a primary winding (primary coil) and a secondary winding (secondary coil) for generating an ignition spark for the internal combustion engine, in particular in its combustion chamber, such as in a cylinder, are accommodated in this housing. In this case, a number of input ports are provided, in particular for connecting an electrical energy source for the supply of the, or of each, ignition transformer and/or for supplying sensor or control signals. Further, a number of output ports is provided, in particular for connecting at least one spark plug and/or for emitting (dissipating, dispensing) control signals.

Conveniently, the input ports, and preferably also the output ports, are routed out of the housing for emitting (dissipating, dispensing) control signals. For example, a flat conductor cable is used (employed, utilized) for this purpose.

The energy source can be designed for example as a charging coil or as a generator, in particular as a battery. The energy source is used in particular for the purpose of supplying current or voltage, in particular to the or each ignition coil and/or crankshaft sensor, if this is formed such that it must be connected to a power source for operation.

The optionally supplied sensor or control signals can be, for example, emitted by a temperature sensor, by a pressure sensor, by an injection valve, a throttle, a gasoline pump and/or their associated control units, and/or other control units for mixture formation. In particular for the purpose of emitting control signals, it is further possible to emit corresponding control signals to these components by means of the or of each output port.

In the inventive ignition device, in particular wiring (cabling) and assembly costs are reduced in a particularly advantageous manner due to integrating several individual components, i.e., at least the or each ignition transformer and crankshaft sensor, in a shared housing into a module that can be attached in a single assembly step. This way, these components do not need to be separately mounted on or in the engine during assembly, and do not need to be connected to each other via cable or line. In this way, the ignition device can be mounted in a cost-saving manner.

Furthermore, in a suitable embodiment of the ignition device, its crankshaft sensor is designed as a Hall sensor. For detecting the rotational speed and/or the position of the crankshaft, the position sensor is preferably coupled to the crankshaft in such a way that it co-rotates with the crankshaft. In this case, the position sensor has at least one tooth on its circumference, preferably a number of teeth, more preferably a plurality of teeth. If the tooth or one of the teeth of the toothed position sensor then goes through (passes through) a sensitive area of the Hall sensor, in particular a change in the magnetic field of a Hall sensor magnet (sensor magnet) is detected by virtue of the tooth. In this case, for example, the teeth are spaced irregularly from one another, or alternatively, the teeth are arranged equidistantly, wherein advantageously one tooth is omitted for reference. The detected measured values are then evaluated in a suitable manner with respect to the rotational speed and/or the position of the crankshaft. Alternatively, the crankshaft sensor may be designed as an inductance transmitter (VR sensor, variable reluctance sensor).

An interface to the crankshaft sensor can be further accommodated in the housing. Said interface is routed inside the housing to the energy source via at least one of the input ports. Preferably, the interface provides the measured values acquired by the crankshaft sensor for their further use in particular as measurement data or measurement signals, optionally converts these to a format suitable for further use and/or edits the acquired measurement data accordingly. In this case, the interface to the crankshaft sensor is preferably formed such that it is able to utilize the acquired measured values of different sensor types, such as Hall sensors or inductance transmitters, and provide appropriate measurement data or measurement signals. Thus, for example, the measured values acquired by means of a Hall sensor are provided in such a way that they can also be used by a control unit, which is provided only for the use of measured values acquired by an inductance transmitter, and vice versa. Thus, the interface can be and is advantageously utilized regardless of the type of sensor used.

The interface can also serve to regulate the level and/or the zero adjustment of the acquired measured values of the crankshaft sensor, so that interference signals (background values) caused, for example, by the ignition transformers and acquired by the crankshaft sensor are taken into account, for example, hidden in the further use of the measured values and/or the measurement data or measurement signals that are provided by the interface.

In particular, the interface is connected via the input ports to the electrical energy source, which can be a battery.

An electromagnetic shield of the crankshaft sensor can be integrated in the housing. In particular, this way, interferences during the measuring process of the crankshaft sensor are avoided or at least reduced. For example, disturbances may be caused by the operation of the or each ignition transformer. This is in particular due to the space-saving arrangement, i.e., to a comparatively high integration density of the components accommodated in the housing, that is, at least of the ignition transformer or the ignition transformers and the crankshaft sensor.

The electromagnetic shield can be formed, for example, of a foil or of a metal sheet, in particular of copper. Preferably, the shield surrounds the crankshaft sensor, with the exception of a side facing the crankshaft in the provided assembly state. For example, the shield is tubular, wherein the crankshaft sensor is disposed in the tube interior.

In a first variant of the ignition device, this has only a single ignition transformer. On its primary side, the ignition transformer is connected to a housing-internal actuator and on its secondary side, connected to at least one, preferably two, of the output ports. In other words, the primary winding of the ignition transformer is connected to the actuator and the secondary winding of the ignition transformer is connected to the respective output port(s).

The actuator can be an H-bridge (bridge circuit), in particular in the manner of a four-quadrant H-Bridge. Such an H-bridge can have, for example four semiconductor switches, particularly transistors (power transistors, MOSFETs). In each case, two of the semiconductor switches can be connected in series, and their center taps can be connected to each other via the primary winding. In other words, the primary coil is connected to the so-called bridge branch of the bridge circuit.

By means of a corresponding circuit of the semiconductor switches, in particular, a current direction is adjustable or adjusted in the primary winding. For example, additionally, the corresponding current or a voltage applied to the primary winding is adjustable or adjusted. The current or voltage induced in the secondary winding therefore has a current direction or polarity corresponding to the actuator settings, and a corresponding current or a corresponding magnitude of the induced voltage. In particular, due to the adjustability of the current direction by means of only one ignition transformer, a spark can be generated on the secondary side in the spark plug(s), according to said preferred embodiment in both spark plugs, which are connected to the corresponding output ports.

A control unit, for example, a microprocessor, a microcontroller, an ASIC (application specific integrated circuit) or an FPGA (field programmable gate array), can be integrated or accommodated in the housing. Said control unit is connected to at least one of the input ports on the input side, in particular for the purpose of power supply or for supplying a sensor signal or control signals, and housing-internally, is optionally connected to the interface, in particular for the detection and evaluation of crankshaft sensor signals. Furthermore, the control unit on the output side is routed to the housing-internal actuator for the primary winding of the ignition transformer. In particular, the control unit is additionally connected on the output side to the output port for emitting control signals. For example, in addition, the control unit is configured for the regulation or control of external components, such as the temperature sensor, the pressure sensor, the injection valve, the throttle valve, the fuel pump, and/or for mixture formation.

The control unit, for example a microcontroller or a microprocessor, can be connected to the actuator, which in turn is connected to the primary winding of the ignition transformer. This way, the ignition transformer can be controlled by means of the control unit according to the proper manner of operation.

A current path can be connected in parallel with the secondary winding of the ignition transformer, wherein said path has two diodes mutually connected in the forward direction. The center tap of said diodes is routed to another output port for ground. In this way, a voltage with corresponding polarity is induced on the secondary side, in accordance with the current direction of the current flowing in the primary coil. In other words, at each winding end of the secondary coil, the output port routed to said winding end is supplied with positive or negative voltage (voltage part, high voltage pulse). At the spark plug, which is connected to the output port supplied with the negative, induced high voltage pulse, an ignition spark is generated. In particular, the spark plug is also routed to ground for this purpose. The coil end of the secondary coil on the other hand, which is supplied with the positive induced high voltage pulse, is routed to ground by virtue of the diode that is connected in the forward direction, so that advantageously no wasted spark is generated by means of the spark plug connected to this coil end.

Advantageously, only a single ignition transformer is needed for two spark plugs that are each connected to the corresponding output port. Thus, the ignition device is designed in an advantageous, comparatively space-saving (compact) manner.

Furthermore, both the (high) voltage necessary for generating the ignition and the electronic and/or power electronic components required for controlling a desired ignition point, in particular the crankshaft sensor and the interface thereto as well as the control unit, the actuator and the ignition transformer, are housed in a shared housing. Preferably, these components are interconnected and/or (electrically) connected in such a manner inside the housing that a number of plugs and sockets required for the interconnection, as well as due to the spatial proximity, a necessary length of the corresponding connecting lines (cables) is reduced. For this purpose, they are interconnected, for example, by means of a printed circuit board. In comparison to separately mounting the individual components of the ignition device, the ignition device is thus cost-effectively producible or produced.

Further, two ignition transformers can be accommodated in the housing. Their primary windings are connected via the input ports to the power source and in each case to an input port for an external control unit or, for example, to an external output stage or to power electronics, in particular for the corresponding control and/or energization of the associated ignition transformer. Their secondary windings are routed to the output ports of the or each spark plug.

Furthermore, the detected measured values of the crankshaft sensor and/or the measurement signals or measurement data provided by the interface can be routed to at least one output port for emission, and from there, for example, are further routed to a corresponding control device.

Each or one of the ignition transformers can have a high voltage diode (EFU diode, closing spark suppression diode) with a forward direction from the corresponding secondary winding to the corresponding primary winding, wherein on the cathode side, the high voltage diode is routed to the input port leading to the energy source. In other words, the primary winding and the secondary winding of the corresponding ignition transformer are each connected by means of a high voltage diode in the forward direction from the secondary winding to the primary winding. The high voltage diode is thereby attached to the end of the primary winding connected to the power source, and is connected to that end of the secondary winding which is not routed to the respective output port. In particular, during startup of the primary current, a current would be induced in the corresponding secondary winding, which has a current direction that is reverse (opposite) to the operational ignition process. In this case, an undesirable so-called switch-on spark could arise. However, by means of the high voltage diodes with the above-described forward direction, a current in this reverse current direction and thus the switch-on spark are advantageously avoided (suppressed).

For example, the ignition transformers, and optionally the interface and the crankshaft sensor, can also be interconnected by means of a printed circuit board.

The crankshaft sensor can be accommodated in a housing pocket, which in the assembled state has a pocket bottom located on the crankshaft side. In other words, preferably the housing includes a housing pocket, which is raised towards the housing side (containing said pocket), and in which the crankshaft sensor is accommodated. In this case, the pocket bottom faces the crankshaft in the assembled state of the ignition device on the combustion engine. In this way, the sensor is positionable or positioned closely enough to the position sensor, which is coupled to the crankshaft, that it is comparatively possible to reliably detect the teeth of the position sensor.

Conveniently, the housing is provided and configured for mounting on an internal combustion engine, in particular on the cylinder of an internal combustion engine. Preferably, the housing is arranged such that the housing can be mounted to existing attachment points.

This way, the ignition device can also be advantageously mounted on combustion engines which are already manufactured and, for example, configured for other, existing ignition devices. Thus, for example, during maintenance or repair, the existing and possibly defective ignition device can be replaced with the inventive ignition device.

In particular, if the internal combustion engine can be designed according to a V-type, that is to say if the internal combustion engine has two cylinders or two cylinder banks which are inclined relative to one another at a (bank) angle with respect to the crankshaft, then the housing is designed according to an alternative variant for mounting the ignition device on a cylinder in such a way that it is fastened, for example screwed, to the two cylinders of the internal combustion engine. In each case, an existing attachment point of each cylinder is preferably used. The ignition device is arranged circumferentially to the position sensor in the region of the two cylinders.

For example, the housing can have a retaining tab for mounting on the respective cylinder, with intakes for a mount that are formed as recesses. These are introduced in the housing according to the positioning of the existing attachment points. The attachment points of the cylinder are also referred to as mounting domes.

The housing, with at least one crankshaft sensor and ignition transformer arranged therein, can be poured (cast) with a potting compound, which is, for example, self-curing. In particular, this is to facilitate high voltage strength of the ignition device, to insulate the windings of the or each ignition coil, and/or to protect the components accommodated in the housing from mechanical stress or from moisture. Preferably, the potting compound is temperature resistant for the intended operation on the engine. In particular, the potting compound is dimensionally stable up to a temperature of 200° C.

Further scope of applicability of the present invention will become apparent from the detailed description given hereinafter. However, it should be understood that the detailed description and specific examples, while indicating preferred embodiments of the invention, are given by way of illustration only, since various changes, combinations, and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
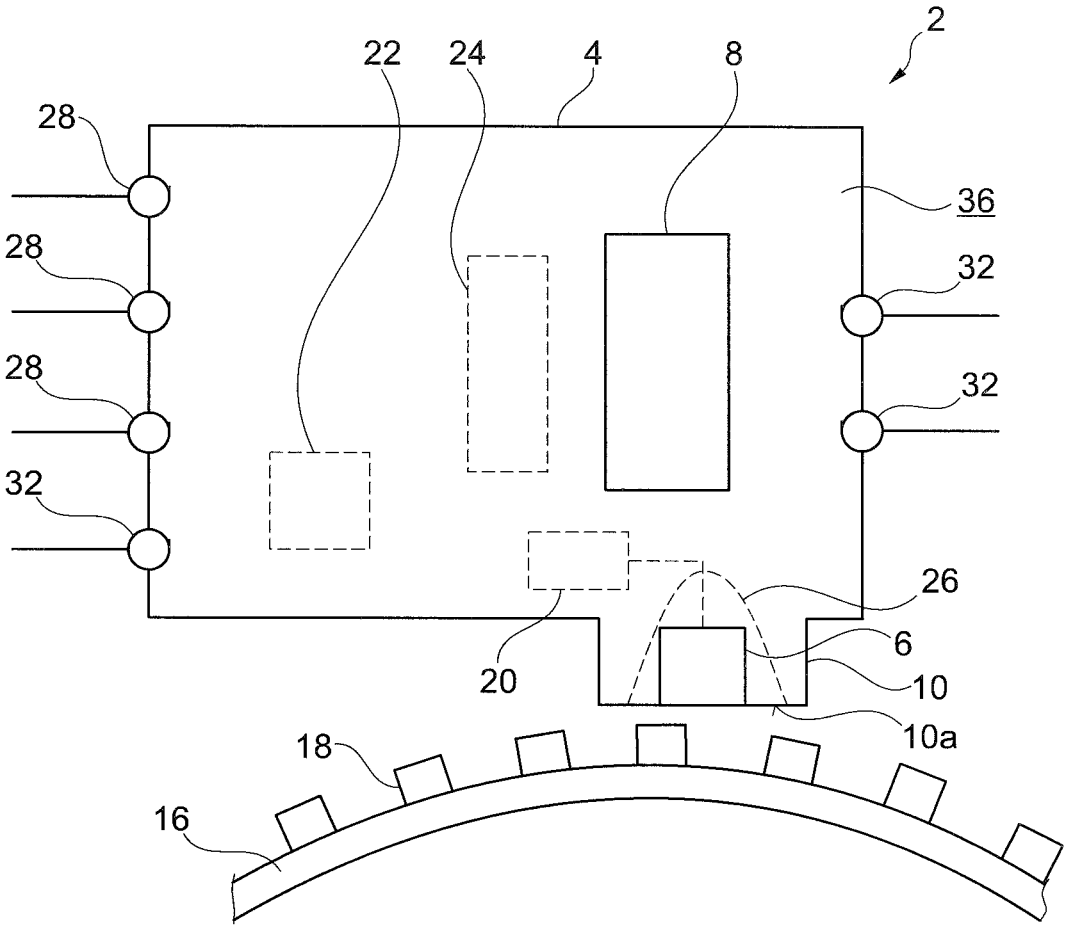
FIG. 1 is a schematic representation of the ignition device, having a housing, in which at least one crankshaft sensor and an ignition transformer arrangement are accommodated, wherein the crankshaft sensor is arranged in a housing pocket.
Figure 7:
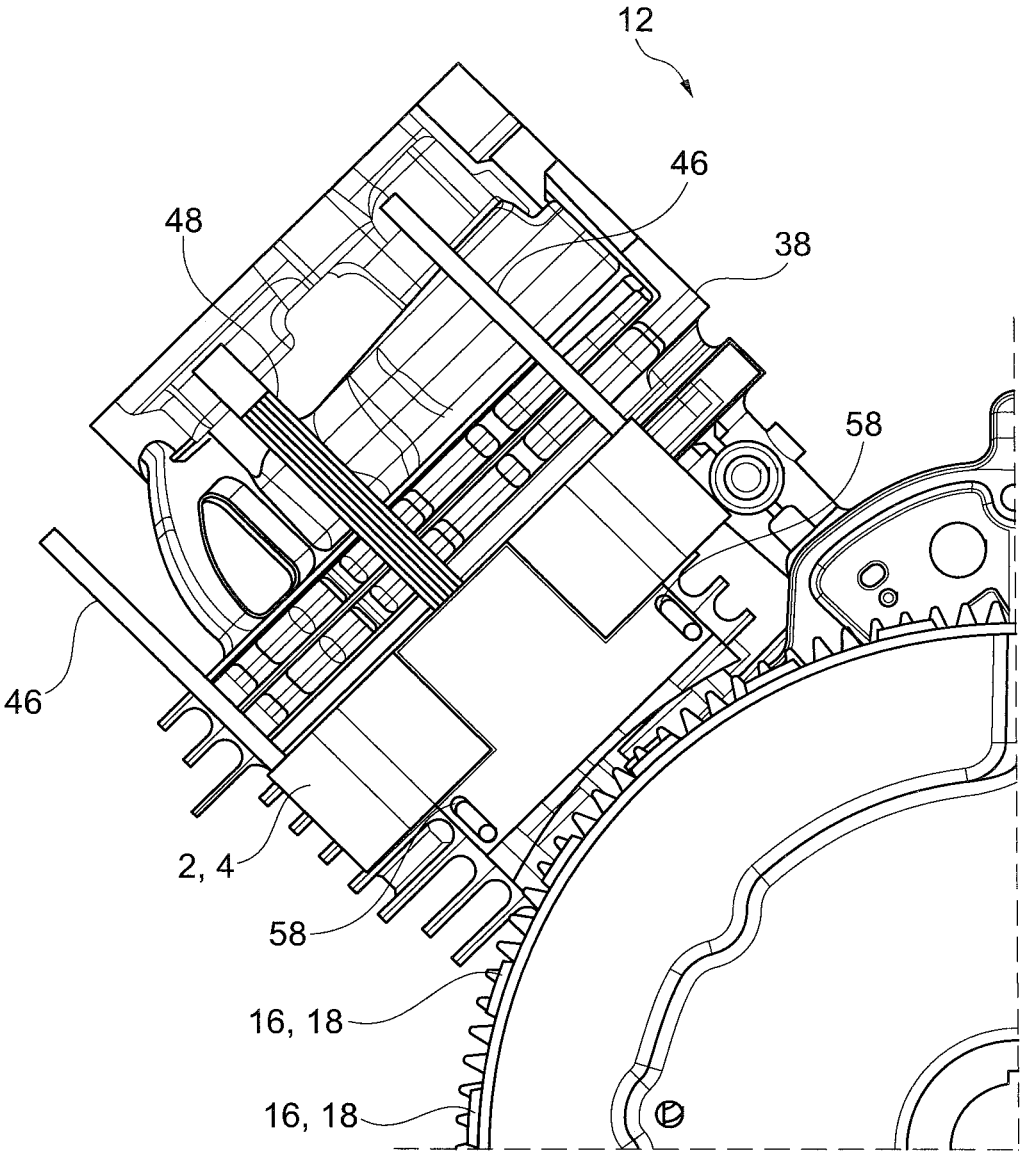
FIG. 7 illustrates the ignition device in the assembled state on a cylinder of an internal combustion engine.

FIG. 1 shows a schematic representation of an ignition device 2. This comprises a housing 4, in which a crankshaft sensor 6 and an ignition transformer arrangement 8 are accommodated. The crankshaft sensor 6 is designed as a Hall sensor. Further, said sensor is arranged in a housing pocket 10, which faces a crankshaft 14 in the assembled state of the ignition device 2 on an internal combustion engine 12 (FIG. 7). In summary, a pocket bottom 10*a* of the housing pocket 10 is arranged on the crankshaft side. In this case, a position sensor 16 with teeth 18 is coupled to the crankshaft 14 so that the teeth are adjusted during a rotation of the crankshaft 14 by a sensitive region of the crankshaft sensor 6. This adjustment movement produces a voltage signal of the Hall sensor, which is recorded as a measured value(s). By means of the measured values, the rotational speed and/or position of the crankshaft 14 is detected. In this case, at least one tooth 18 is omitted for reference purposes.

The ignition transformer arrangement 8 includes at least one ignition transformer 8*a*. The or each ignition transformer 8*a* in turn has a primary winding 8*b* and a secondary winding 8*c*, and a (iron) core 8*d* for generating a spark F on the internal combustion engine 14.

FIGS. 2 to 7 show two variants of the ignition device 2. According to these variants, further components are accommodated in the housing 4. In FIG. 1, these components are shown in dashed lines. These components are an interface 20 to the crankshaft sensor 6, a control unit 22, and an actuator 24, which is preferably designed as an H-bridge. In addition, an electromagnetic shield 26, which comprises the crankshaft sensor 6 on the inside of the housing, is integrated in the housing 4. By means of this shield 26, the crankshaft sensor 6 is thus in particular shielded from an interference field originating from the ignition transformer arrangement 8.

Figure 2:
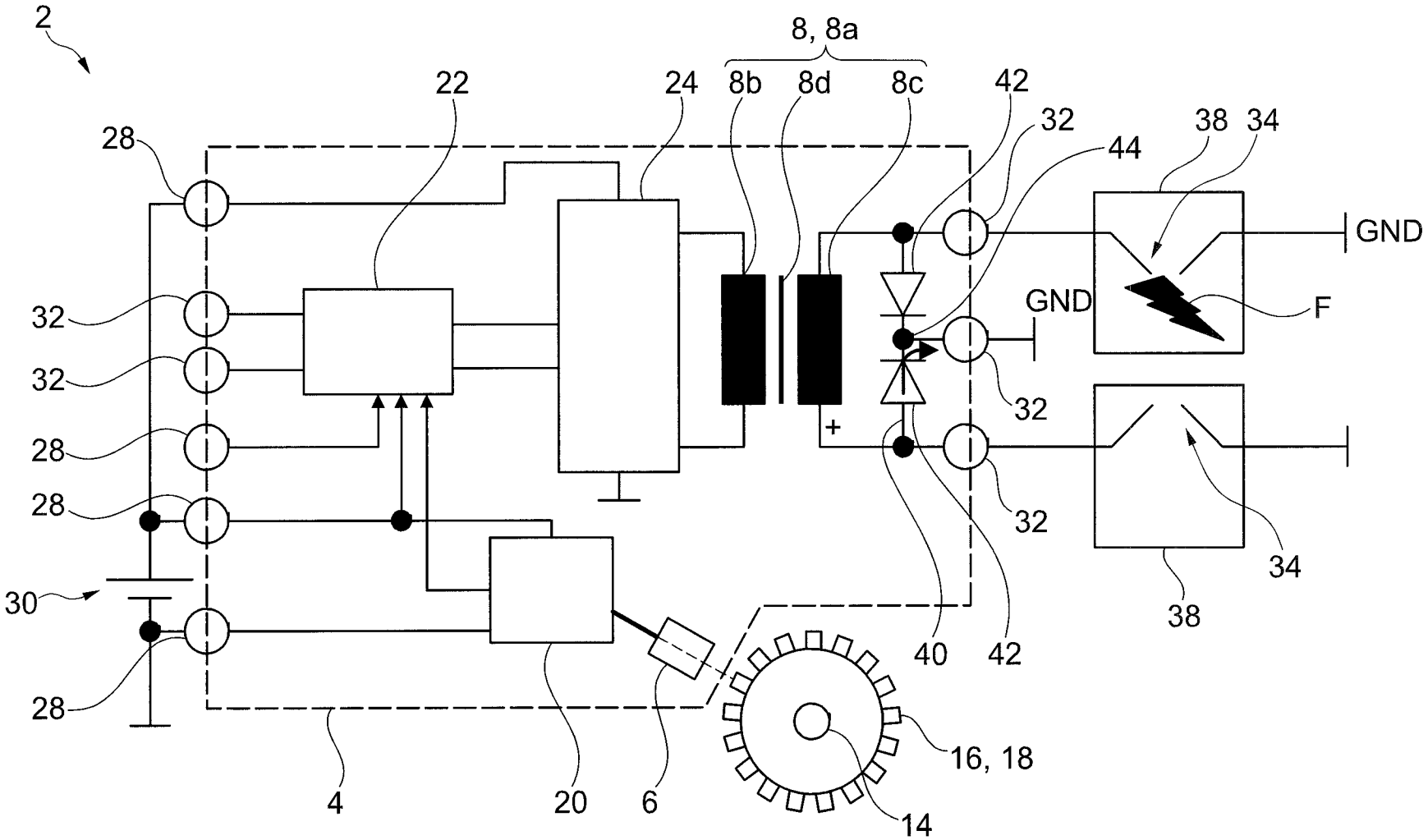
FIG. 2 is a block diagram of an ignition device according to FIG. 1, wherein the ignition transformer arrangement comprises an ignition transformer which is connected to a housing-internal actuator, and wherein a control unit is accommodated in the housing.

Further, three input ports 28 are provided, two of which are used for connecting an electrical power source 30 (FIGS. 2 and 4), which is formed in all embodiments as a battery, and for supplying the or each ignition transformer 8*a* of the ignition transformer arrangement 8. The other input port 28 is for supplying sensor or control signals from a housing-external sensor or control unit. Furthermore, three output ports 32 are provided. One of the output ports 32 serves to derive a control signal from the interface 20 (FIG. 4, second variant of the ignition device 2) or from the control unit 22 (FIG. 2, first variant of the ignition device 2). The two other output ports 32 are provided for connecting two spark plugs 34.

According to the embodiments as per the variants shown in FIGS. 2 to 7, these input ports 28 and output ports 32 are shared. In the respective variants, however, additionally corresponding input ports 28 and/or output ports 32 are provided.

For the purposes of improved high voltage strength, the housing 4, including the components accommodated therein as per the respective embodiment of the ignition device 2, is cast with a potting compound 36.

FIG. 2 shows a block diagram of the first variant of the ignition device 2. Here, the interface 20 to the crankshaft sensor 6 is accommodated in the housing 4. Said interface is on the one hand routed to the electric power source 30 via the input ports 28. On the other hand, the crankshaft sensor 6 is connected to the interface 20.

Furthermore, in this embodiment, the ignition transformer arrangement 8 has only one ignition transformer 8*a*. On the primary side, the latter is connected by the housing-internal actuator 24, and on the secondary side, by the two winding ends of the secondary winding 8*c*, to in each case one output port 32. A spark plug 34 of a cylinder 38 of the internal combustion engine 12 is connected to each of these two output ports 32. The spark plugs 34 are routed to ground GND.

In addition, the control unit 22 is accommodated in the housing 4. In this case, the control unit 22 is connected on the input side to the input port 28 for supplying sensor or control signals, and to the energy source 30 via an input port 28. Furthermore, the control unit 28 is connected inside the housing to the interface 20, in particular for supplying measured values detected by the crankshaft sensor 6 or measurement data determined therefrom. Further, the control unit 22 is connected to the actuator 24 for the primary winding 8*b* of the ignition transformer 8*a*, in particular for the corresponding control of the actuator 24.

Further, a current path 40 is connected between the two output ports 32, to which the two spark plugs 34 are connected. Said path is also connected in parallel to the secondary winding 8*c* of the ignition transformer 8*a*. In the current path 40, two diodes 42 are connected in series, with their forward direction facing each other. Between these diodes 42, a center tap 44 is connected, which is connected to a further output port 32, which in turn is routed to ground GND.

The coil end of the secondary winding 8*c*, to which a positive induced high voltage pulse, illustrated by means of a plus symbol, is applied, leads to ground GND via the output port 32 by virtue of the diode 42 connected in the forward direction. This is represented by an arrow. As a result, no wasted spark is generated by means of the spark plug 34 connected to this coil end.

Figure 3:
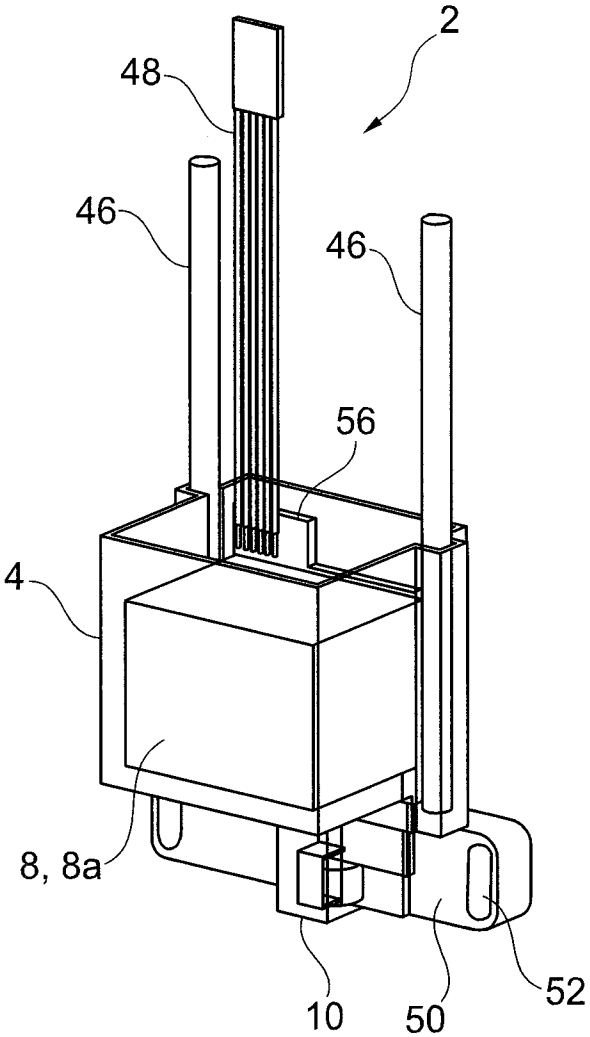
FIG. 3 is a perspective view of the ignition device, wherein ports are routed out of the housing by means of a flat conductor cable.

FIG. 3 shows a perspective view of an embodiment of the first variant. Here, for the purpose of improved visibility, the potting compound 36 is not shown and the housing 4 is shown transparent. Here, the spark plugs 34 are connected in particular in each case by means of a spark plug cable 46 routed out of the housing 4 to the corresponding output port 32. The input ports 28 and the output ports 32, to which the spark plugs 34 are not connected, lead out of the housing 4 as flat conductor cables 48.

Furthermore, on the housing side of the housing 4 on which the housing pocket 10 is arranged, a retaining tab 50 is also disposed, in particular integrally formed. This has slot-like recesses 52 acting as intakes for a mount, in which screw elements are received on the combustion engine 12 during mounting of the ignition device 2.

Figure 4:
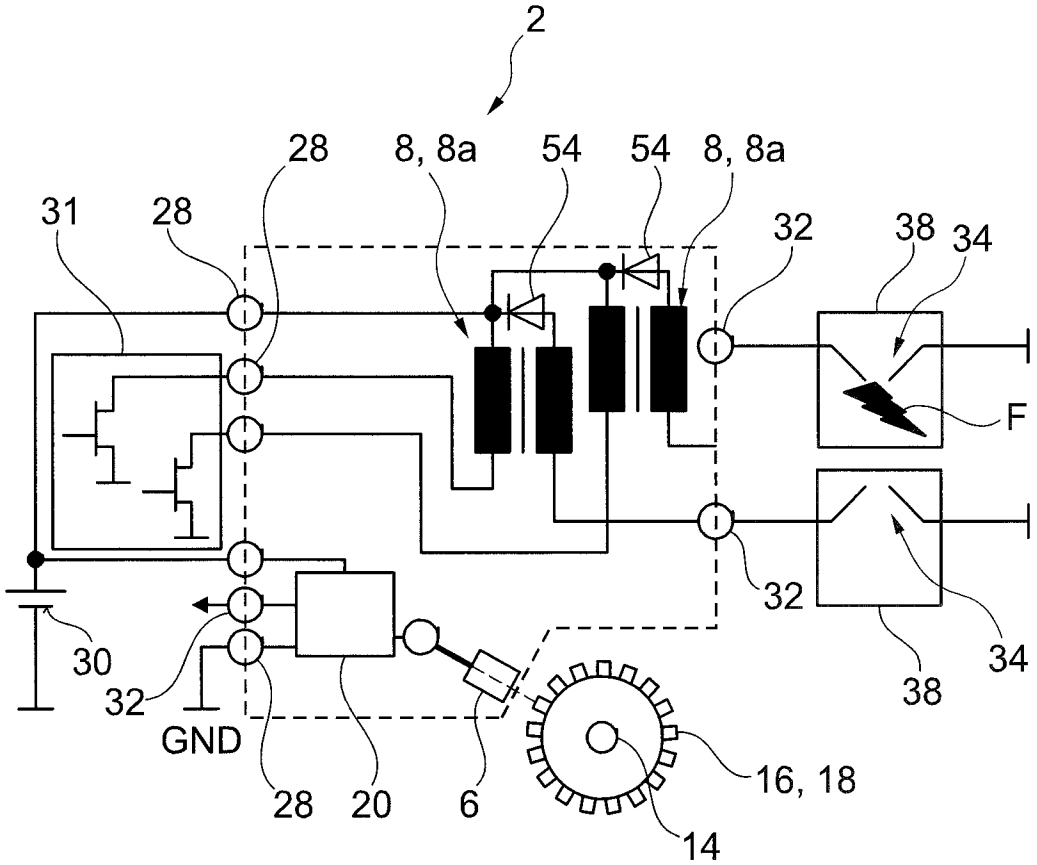
FIG. 4 is a block diagram of the ignition device according to FIG. 1, wherein an interface to the crankshaft sensor is accommodated, and wherein the ignition transformer arrangement has two ignition transformers.

FIG. 4 shows a block diagram of the second variant of the ignition device 2. In this case, the ignition transformer arrangement 8 has two ignition transformers 8*a*. Their primary windings 8*a* are routed to one of the input ports 38 to the power source 30 as well as in each case, to one of the input ports 28 of a rudimentarily shown external control unit 31. Furthermore, their secondary windings each lead to an output port 32 to which a spark plug is connected, which is connected to ground 34.

Further, the interface 20 accommodated in the housing 4 leads to the output port 32 for emitting a control signal.

In addition, both ignition transformers 8*a* each have a high voltage diode 54 to avoid a switch-on spark. For this purpose, in each case the primary winding 8*b* and the secondary winding 8*c* of the corresponding ignition transformer 8*a* are connected by means of the high voltage diode, with the forward direction from the secondary winding 8*c* to the primary winding 8*a*. In this case, the high voltage diode 54 is connected to the end of the primary winding 8*b*, which is connected to the power source 30, and is connected to that end of the secondary winding 8*c* which does not lead to the corresponding output port 32.

Figure 6:
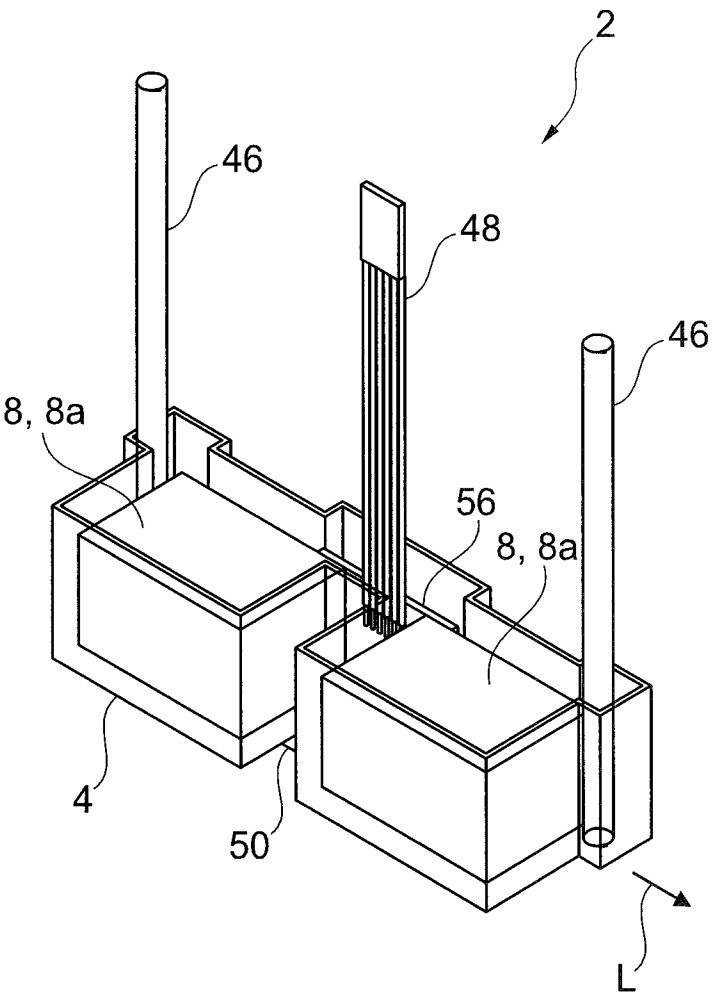
FIG. 6 is a perspective view of the ignition device, wherein the two ignition transformers have a shared transformer longitudinal axis which is oriented parallel to the housing side having the housing pocket.
Figure 5:
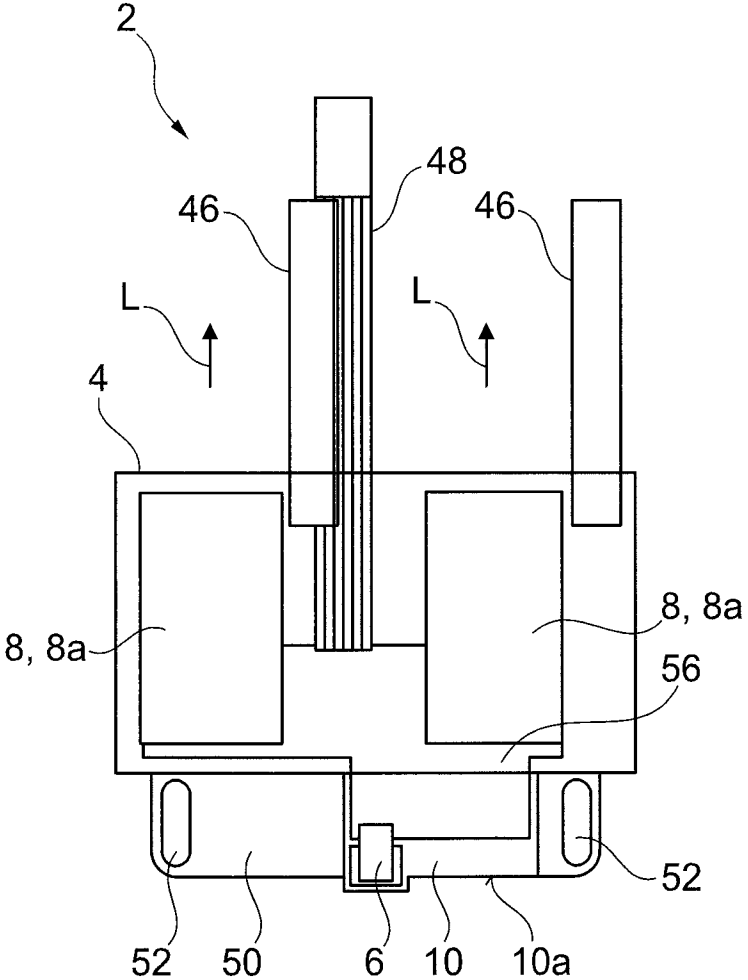
FIG. 5 is a plan view of the ignition device, wherein transformer longitudinal axes of the two ignition transformers extend in parallel and are spaced apart and oriented perpendicular to the housing side having the housing pocket.

FIGS. 5 and 6 show the two embodiments of the second variant of the ignition device 2. Analogous to the embodiment of FIG. 3, in this case the potting compound 36 is not shown for improved visibility and the housing 4 is shown transparent. Also analogous to the embodiment according to FIG. 3, two spark plug cables 46 as well as the input ports 38 and the output ports 32, to which the spark plugs 34 are not connected, lead out of the housing as flat conductor cables 48. In addition, the housings 4 of the embodiments of FIGS. 5 and 6 in each case comprise the retaining tab 50 with the recesses 52 for mounting the housing 4 on the internal combustion engine 12.

According to FIG. 5, the (winding axis) transformer longitudinal axes L of the two ignition transformers 8*a* are arranged in parallel and at a distance from one another. These further extend perpendicular to the housing side of the housing 4 at which the housing pocket 10 is arranged. In contrast, the transformers 8*a* of the embodiment of FIG. 6 share a common transformer longitudinal axis L which runs parallel to the housing side, which comprises the housing pocket 10. A magnetic field, which is caused when a current flows through the windings 8*c* and 8*b* of one or both ignition transformers, comprises in the embodiment of FIG. 6, in particular in comparison to the embodiment of FIG. 5, a comparatively small magnetic field strength in the region of the crankshaft sensor 6, so that a measuring operation of the crankshaft sensor 6 is less disturbed by this magnetic field.

In the embodiments of FIGS. 3, 5 and 6, for example, a circuit board 56 is received in the housing 4, by means of which the components in the housing, i.e., at least the crankshaft sensor and the at least one ignition transformer, are interconnected. Further, in these figures, the coupling of the spark plug cables 46 with the appropriate ignition transformers 8*a* is not further shown.

FIG. 7 shows the ignition device 2 in the assembled state, on the cylinder 38 of the internal combustion engine 12 shown in sections. The housing 4 is mounted such that the crankshaft sensor 6 accommodated in the housing pocket 10 faces the crankshaft 14 and is able to detect the (metal) teeth 18 of the outlined position sensor 16. Here, the ignition device 2 is in particular attached to existing attachment points 58, which are provided for mounting an (old, non-inventive) ignition device.

Figure 8:
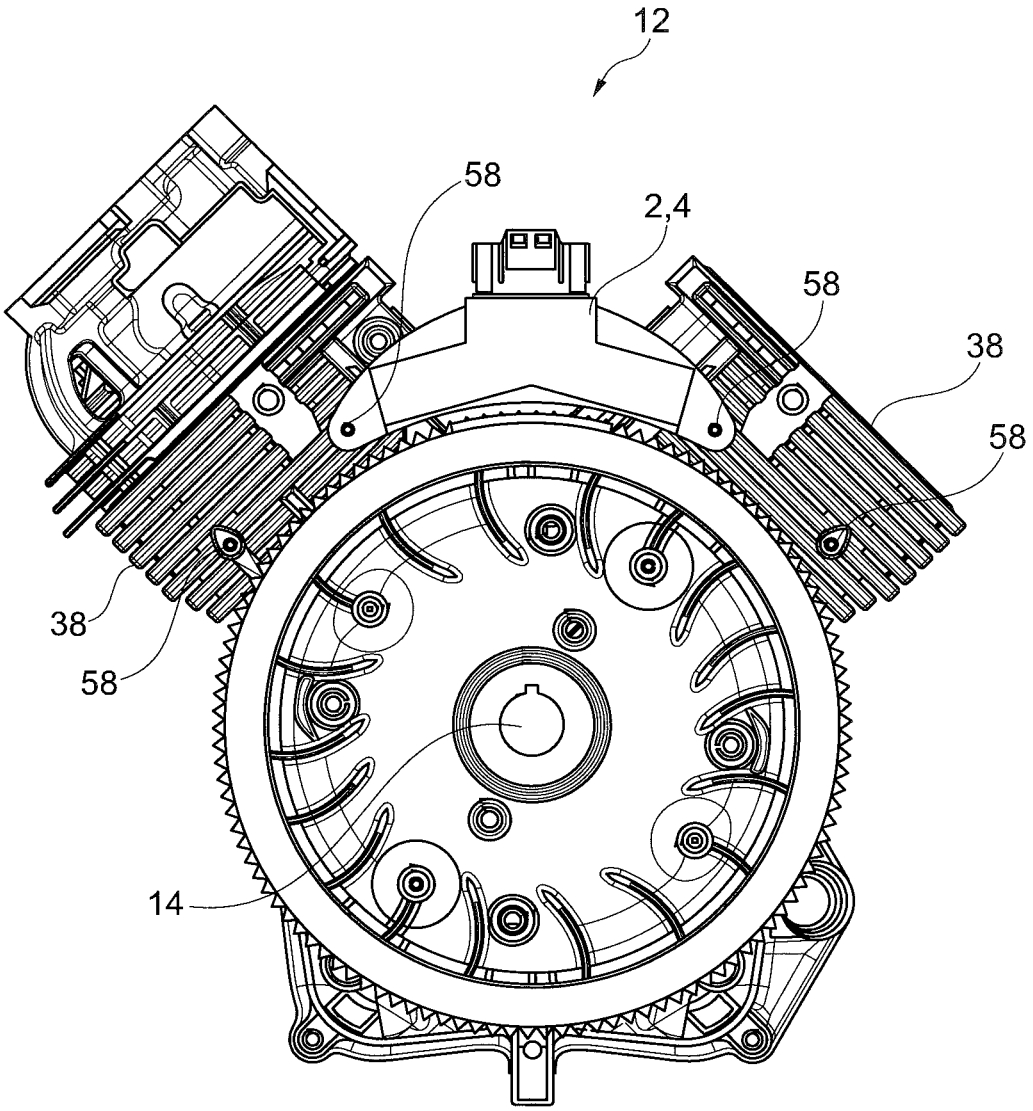
FIG. 8 illustrates the ignition device in the assembled state, wherein the ignition device is attached to two cylinders of the internal combustion engine.

FIG. 8 shows the ignition device 2 in the assembled state on a V-type combustion engine 12. This has two cylinders 38, which are inclined at a (bank) angle to each other with respect to the crankshaft 14. The two cylinders 38 each have two existing attachment points 58, for example, for mounting an (old, not inventive) ignition device. The attachment points 58 are arranged in a shared plane which runs perpendicular to the crankshaft 14.

The housing 4 of the ignition device 2 is attached to both cylinders 38. For this purpose, an existing attachment point 58 of each cylinder is used in each case. The intakes for the mount formed as recesses 52 are disposed in the retaining tab 50 of the housing 4 in accordance with the positioning of the existing attachment points 58.

The ignition device 2 is arranged circumferentially of the position sensor 16 in the region of the two cylinders 38.

The invention is not limited to the embodiments described above. On the contrary, other variants of the invention can be derived by those skilled in the art without departing from the subject matter of the invention. In particular, all individual features described in connection with the exemplary embodiments can also be combined with one another in other ways without departing from the subject matter of the invention.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. An ignition device for an internal combustion engine, the ignition device comprising:

a housing;

a crankshaft sensor for detecting a rotational speed and/or a position of a crankshaft;

at least one ignition transformer having a primary winding and having a secondary winding for generating an ignition spark for the internal combustion engine;

the housing having at least one input port for connecting an electrical power source for supplying the at least one ignition transformer and/or for supplying a sensor and/or control signal; and the housing having at least one output port for connecting at least one spark plug and/or for emitting a control signal, wherein the crankshaft sensor and the at least one ignition transformer, including the primary winding and the secondary winding, are provided inside of the housing.

2. The ignition device according to claim 1, wherein the crankshaft sensor is a Hall sensor.

3. The ignition device according to claim 1, further comprising an interface to the crankshaft sensor, the interface being provided inside the housing, and the interface being routed inside the housing to the at least one input port.

4. The ignition device according to claim 3, further comprising an actuator provided inside the housing, and wherein a single one of the at least one ignition transformer is provided in the ignition device, which on a primary side is connected to the actuator and on a secondary side is connected to the at least one output port, wherein the actuator is an H-bridge.

5. The ignition device according to claim 4, further comprising a control unit provided inside the housing, which on an input side is routed to the at least one input port and is routed housing internally to the interface, and on an outlet side, is routed to the actuator for the primary winding of the single one of the at least one ignition transformer.

6. The ignition device according to claim 4, further comprising a current path provided inside of the housing, the current path being connected in parallel to the secondary winding of the single one of the at least one ignition transformer, the current path having two diodes interconnected in a forward direction of which a center tap is routed to a further output port for grounding.

7. The ignition device according to claim 1, further comprising an electromagnetic shield that at least partially surrounds the crankshaft sensor, the electromagnetic shield being provided inside the housing.

8. The ignition device according to claim 7, further comprising an interface to the crankshaft sensor, the interface being provided inside the housing, and wherein the electromagnetic shield is positioned between the interface and the crankshaft sensor.

9. The ignition device according to claim 1, wherein two of the at least one ignition transformer are provided inside the housing, of which the primary windings are routed to the electrical power source via the at least one input port and to a respective input port for an external control unit, and of which the secondary windings are routed to the at least one output port for the at least one spark plug.

10. The ignition device according to claim 9, wherein each of the two of the at least one ignition transformer comprises a high voltage diode with a forward direction from the corresponding secondary winding to the corresponding primary winding, wherein the high voltage diode is routed on a cathode side to the at least one input port leading to the electrical power source.

11. The ignition device according to claim 10, further comprising an interface to the crankshaft sensor, the interface being provided inside the housing, and the interface being routed inside the housing to the at least one input port.

12. The ignition device according to claim 1, wherein the crankshaft sensor is provided inside a housing pocket of the housing that faces the crankshaft, the housing pocket having a pocket bottom located on a crankshaft side of the housing pocket.

13. The ignition device according to claim 1, wherein the housing comprises a mount for mounting on existing attachment points of a cylinder of an internal combustion engine or on a respective attachment point of two cylinders of a V-type internal combustion engine.

14. The ignition device according to claim 1, wherein the housing, with at least the crankshaft sensor and the at least one ignition transformer disposed therein, is cast with a potting compound.

15. The ignition device according to claim 1, wherein the crankshaft is provided with a toothed position sensor.

* * * * *